United States Patent [19]

Kawasaki et al.

[11] Patent Number: 4,872,245

[45] Date of Patent: Oct. 10, 1989

[54] METHOD AND APPARATUS FOR MANUFACTURING COLD-ROLLED STEEL STRIP

[75] Inventors: Yoshiki Kawasaki; Yoshihiro Hioki; Yuichi Ohno, all of Himeji; Kozaburo Ichida; Susumu Yamaguchi, both of Kitakyushu; Michitaka Sudo, Tokyo; Bunichiro Chikazawa, Kitakyushu, all of Japan

[73] Assignee: Nippon Steel Corporation, Tokyo, Japan

[21] Appl. No.: 143,311

[22] Filed: Jan. 11, 1988

Related U.S. Application Data

[63] Continuation of Ser. No. 838,563, Mar. 11, 1986, abandoned.

[30] Foreign Application Priority Data

| | | | |
|---|---|---|---|
| Mar. 15, 1985 | [JP] | Japan | 60-50344 |
| Nov. 22, 1985 | [JP] | Japan | 60-261294 |
| Nov. 22, 1985 | [JP] | Japan | 60-261295 |

[51] Int. Cl.[4] ..... B21C 43/00

[52] U.S. Cl. ..... 29/81 A; 29/81 G; 29/81 H; 72/227; 72/234; 72/40; 134/63

[58] Field of Search ..... 29/81 A, 81 R, 81 G, 29/81 H; 72/226, 227, 234, 39, 40; 134/64 R, 63

[56] References Cited

U.S. PATENT DOCUMENTS

| | | | |
|---|---|---|---|
| 2,196,600 | 4/1940 | Wean et al. | 29/81 A |
| 2,238,667 | 4/1941 | Wales | 29/81 A |
| 2,259,277 | 10/1941 | Theiss | 29/81 A |
| 2,359,095 | 9/1944 | Elder et al. | 29/81 A |
| 3,039,513 | 6/1962 | Lasiewicz et al. | |
| 3,209,429 | 10/1965 | Amtmann | 29/81 A |
| 3,587,276 | 6/1971 | Randich | 72/227 |
| 3,918,282 | 11/1975 | Elbe . | |
| 4,179,913 | 12/1979 | Martt | 72/227 |
| 4,188,812 | 2/1980 | Nomura et al. . | |

FOREIGN PATENT DOCUMENTS

| | | | |
|---|---|---|---|
| 2350503 | 10/1973 | Fed. Rep. of Germany . | |
| 0019105 | 2/1982 | Japan | 72/227 |
| 57-22803 | 5/1982 | Japan . | |
| 59-212115 | 1/1984 | Japan . | |
| 59-136430 | 8/1984 | Japan . | |
| 83437 | 6/1981 | Luxembourg . | |
| 2072068A | 9/1981 | United Kingdom . | |

*Primary Examiner*—Carl E. Hall
*Assistant Examiner*—Irene Cuda
*Attorney, Agent, or Firm*—Wenderoth, Lind & Ponack

[57] ABSTRACT

A cold-rolled strip manufacturing apparatus, in which a continuous cold reduction mill and a continuous annealing furnace are directly linked together, has a tension-leveller-type scale breaker for elongating hot-rolled breakdown by 2 to 7 percent, a scale scrubbing brush unit and an immersion-type continuous pickling tank installed upstream of the continuous cold reduction mill.

Descaling of the hot-rolled strip coil is carried out by breaking the mill scale formed on its surface by causing the running strip to elongate and then the broken scale is removed from the surface. The percent elongation given to the strip is feedforward controlled on the basis of the manufacturing conditions of the hot-rolled strip coil and/or the properties and quantity of the mill scale formed. In another descaling method, the percent elongation given to the strip is feedback controlled on the basis of the condition of scale breaking and removing that is detected during the period in which the mill scale is broken and removed.

27 Claims, 7 Drawing Sheets

A
C
26
21
19
20
14
13
11
6
10
9
7
8
5
3
2
H
1
4

40
40
38
34
36
32
30
28
B

SYMBOL
LENGTHWISE POSITION
STEEL TYPE
COILING TEMPERATURE
MIDDLE
PHOSPHORUS-BEARING ALUMINUM-KILLED STEEL
730
TAIL
MIDDLE
TITANIUM-BEARING EXTRA-LOW CARBON STEEL
730
TAIL
PICKLING TIME (sec.)
40
30
20
10
0
ELONGATION (%)
0
1
2
3
4
5

METHOD AND APPARATUS FOR MANUFACTURING COLD-ROLLED STEEL STRIP

This application is a continuation, of now abandoned application Ser. No. 838,563, filed Mar. 11, 1986, now abandoned.

BACKGROUND OF THE INVENTION

1, Field of the Invention

This invention relates to a method and apparatus for manufacturing cold-rolled steel strip and more particularly to a method and apparatus for removing the scale formed on the surface of hot-rolled steel strip that is used as the breakdown in the cold reduction process.

2, Description of the Prior Art

In the cold reduction of hot-rolled coils, the scale formed on the surface of hot-rolled coils which serve as the starting material must be removed before they are subjected to cold reduction in order to obtain finished products of satisfactory surface quality. A popularly employed descaling practice is pickling by immersion in such acidic solutions as hydrochloric and sulphuric acids.

Ideas of continuously performing pickling and cold reduction have already been disclosed in Japanese Patent Publication No. 35594-1979, Japanese Provisional Patent Publication No. 127777-1981, and so on. Also already known is the direct linkage of cold reduction and continuous annealing processes that are carried out continuously. Still, a practice to continuously perform pickling, cold reduction and continuous annealing over a series of directly connected lines has been non-existent.

In order to perform continuous annealing, cold reduction and continuous annealing in succession using conventionally known means, a pickling tank according to Japanese Patent Publication No. 35594-1979, for example, must be placed upstream of a tandem cold reduction mill. But this combination presents the following problem.

Depending on the type of steel processed, the pickling rate of a coil can vary from one spot to another, such as in its leading end, middle and tail end. Accordingly, the leading and tail ends, which are usually slower to get pickled, cannot be pickled to the same extent as the middle portion unless they are passed through a pickling tank at a slower speed. The speed drop in the pickling tank entails a reduction in the threading speed on the following tandem rolling mill, which in turn unavoidably affects the strip travel speed through the following continuous annealing furnace. The speed change in the continuous annealing furnace has a direct bearing on the quality of the product. Besides, it is extremely difficult to keep a change in the annealing condition under good control. To allow the downstream processes to remain unaffected by such a change in the pickling rate, a long looper must be installed, with additional capital expenditure and operational complexity ensuing.

On the other hand, several methods have been proposed to perform descaling at low cost. A descaling method according to Japanese Provisional Patent Publication No. 89318-1981 comprises breaking the mill scale of hot coils on a four-high temper mill and subsequently pickling. A method according to Japanese Provisional Patent Publication No. 127835-1975 and Japanese Patent Publication No. 142710-1982 removes the mill scale that has been broken on a four-high temper mill with sweeping means and then subjects the stock to light pickling, liquid honing or other descaling treatment. Another method according to Japanese Provisional Patent Publication No. 209415-1983 pickles away the mill scale that has been broken by a tension-leveller-type scale breaker.

All these methods involve a step to mechanically break the scale on the surface, which is implemented by use of a four-high temper mill or a tension-leveller-type scale breaker. By providing a light draft or tension-induced elongation, the four-high temper mill and tension-leveller-type scale breaker initiate cracks in intrinsically brittle scale, eventually breaking it. The broken scale is removed from the hot coil surface in the next step.

Elongation given to the travelling hot coil results in the occurrence of cracks in, and the subsequent breaking of, the brittle mill scale formed thereon, running perpendicularly to the direction of elongation. Acid easily penetrates into the interface between the scale and base metal and also into the scale layer itself. So the cracked scale readily comes off from the metal surface on being pickled, or, otherwise, when it is mechanically brushed or shot-blasted.

But these conventional descaling methods are not without shortcomings.

Descalability depends on the chemical composition of the scale, the number of pores and cracks therein and the thickness thereof which, in turn, vary widely with the manufacturing conditions of the hot coil. Accordingly, metal surface damage due to overpickling or insufficient descaling due to underpickling could occur unless the hot coil is elongated to such an extent as will measure up to the descalability of the stock. If, for example, the amount of elongation is set to the material of the poorest descalability, steels or spots within the coil that are more sensitive to pickling might suffer from excessive attack of the base metal. Despite this, no attempt has been made to adjust the level of elongation to the descalability of the material. Under-elongation leads to the feeding of insufficiently descaled material coils into the subsequent cold reduction process and the impairment of the finished product surface quality. Over-elongation, on the other hand, necessitates a greater power requirement and electricity charge on the scale-breaking temper mill or tension-leveller-type scale breaker.

SUMMARY OF THE INVENTION

An object of this invention, in view of the above, is to provide a continuous cold-rolled strip manufacturing apparatus that permits direct linkage of continuous pickling, cold reduction and annealing processes without employing a long looper.

Another object of this invention is to provide a hot coil descaling method that can be implemented economically, efficiently and without fail in the manufacture of cold-rolled strip.

In order to achieve the above objects, a cold-rolled strip manufacturing line according to this invention, in which a continuous cold reduction mill and a continuous annealing furnace are directly linked, has a tension-leveller-type scale breaker that gives not more than 7 percent elongation to the stock handled, a scale scraping brush and an immersion-type continuous pickling tank provided, in that order, upstream of the continuous cold reduction mill.

According to this invention, the tension-leveller-type scale breaker causes the material stock to elongate by 7 percent maximum over the entire length thereof, with the speed of travel of the stock through the pickling process substantially uniform, before proceeding to the subsequent continuous cold reduction process. This eliminates the need for providing a long looper to absorb a change in the travel speed of the stock between the pickling tank and continuous cold reduction mill. Also, application of pre-pickling mechanical descaling permits cutting down the length of the pickling tank.

The hot-rolled breakdown descaling method of this invention comprises the steps of breaking the mill scale formed on the surface of hot-rolled strip by imparting elongation to the travelling stock and removing the broken scale from the steel surface. The amount of elongation imparted is feed-forward controlled on the basis of the manufacturing conditions of the hot-rolled breakdown and/or the properties and amount of the mill scale formed thereon. The properties of the mill scale depend on the chemical compostion (percentages of FeO, $Fe_3O_4$ and $Fe_2O_3$) thereof, the density of cracks propagated therein, and some other factors.

The manufacturing conditions affecting the level of elongation include the coiling temperature, cooling condition, steel type, finishing temperature, length of storage time and stacking condition. Some of these parameters, such as the coiling temperature, cooling condition and steel type, are combined for assessment as required. In effect, data transferred from a host computer at the hot rolling mill or other appropriate source are used.

The properties and amount of mill scale are determined by automated detection through a scale meter on the entry side of the descaler, indirect visual observation through an ITV and a direct observation by an inspector, either singly or jointly. The scale meter determines the thickness of scale based on the angle of diffraction and intesity of x rays reflected from the surface and subsurface of the stock. Detection of observation of scale is performed continuously or intermittently.

Based on these data, the draft applied by the temper-mill scale breaker, the tensile force exerted by the tension-leveller-type scale breaker or the roll pressing force of the roller-leveller-type scale breaker is controlled. Assume, for example, that specific manufacturing conditions of hot-rolled breakdown or specific assessment results of scale condition point to a heavy scale buildup or poor descalability. On such occasions, the draft of the temper-mill-type scale breaker, the tensile force of the tension-leveller-type scale breaker or the roll pressing force of the roller-leveller-type scale breaker is increased accordingly. This type of adjustment is conducted from coil to coil or even within a single coil, as required.

In another preferred embodiment of this invention, the breaking or exfoliating condition of scale is detected while scale breaking and descaling are being carried out, with the obtained data fed back to the preceding process for the control of elongation level.

The detection of the breaking or exfoliating condition of scale, which offers the base data for elongation control, is performed as in the case of the detection or observation of scale on the entry side of the descaling equipment mentioned above.

The draft of the temper-mill-type scale breaker, the tensile force of the tension-leveller-type scale breaker or the roll pressing force of the roller-leveller-type scale breaker is controlled in accordance with the detected condition. When, for example, the mill scale has proved to be not thoroughly broken or removed, those scale breaking forces are increased. This adjustment again is made from coil to coil or within a single coil.

In the aforementioned feed-forward and feed-back control, the percentage of elongation should preferably be kept at 7 percent or under because no remarkable saving in descaling time is achieved even if greater elongation is imparted. Of course, the percentage of elongation must be such that will produce large enough cracks in the mill scale to permit subsequent descaling. This control is achieved by automatically or manually adjusting the tensile force of the tension-leveller-type scale breaker and other similar descaling equipment.

Scale breaking is accomplished by a temper mill, a tension-leveller-type scale breaker, roller-leveller-type scale breaker or other devices engineered to elongate hot-rolled breakdowns.

The broken scale is removed by at least one of brushing off, pickling, wet blasting and dry blasting. Any one of these methods may be used singly. And when the descalability of the stock is low, two of them such as brushing off and pickling or pickling and wet blasting, may be employed in combination.

The breaking and removing of scale may be carried out off-line or separately from the cold reduction or continuous annealing process, or, otherwise, immediately prior to cold reduction or a combination of cold reduction and continuous annealing that is conducted in succession.

The manufacturing method and apparatus according to this invention consistently provide a large enough elongation to hot-rolled breakdowns for adequate descaling. As a result, no residual scale is present to impair the surface quality of the cold-rolled end product. In addition, there no longer exists the need to consume greater power in the operation of temper-mill, tension-leveller or other type of scale breaker.

DESCRIPTION OF THE PREFERRED EMBODIMENTS

Preferred Embodiment I

Figure 1A:
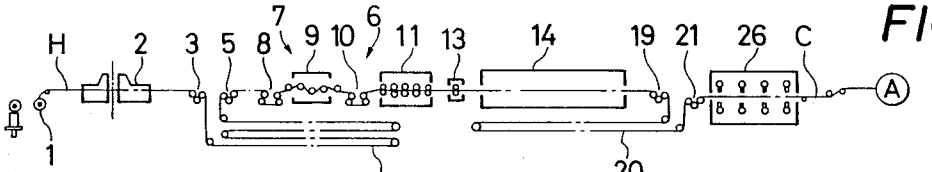
FIGS. 1A and 1B show a schematic overall side elevation showing a preferred embodiment of a continuous cold-rolled strip manufacturing apparatus according to this invention.
Figure 1B:
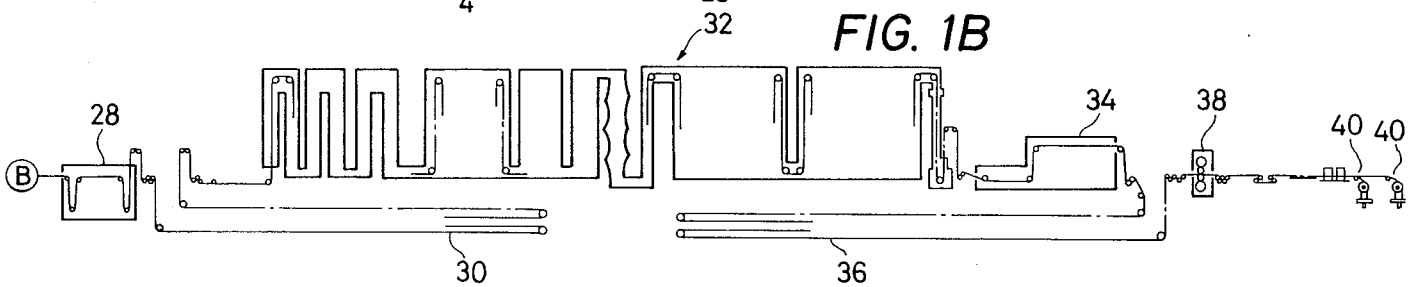

FIGS. 1A and 1B show an example of a continuous cold reduction line comprising essentially a mechanical descaler 6, a pickling tank 14, a tandem cold reduction mill 26 and a continuous annealing furnace 32.

The mechanical descaler 6 is made up of a tension-leveller-type scale breaker 7, which comprises bridles 8 and 10 and a set of bending rollers 9 interposed therebetween, and a brushing unit 11 comprising a plurality of scale-scrubbing brush rolls.

A hot-rolled breakdown H to be processed travels from a payoff reel 1 through a bridle 3, a looper 4 and a bridle 5 to the mechanical descaler 6, and thence to the pickling tank 14 via a side trimmer 13. After being pickled, the breakdown H passes through a bridle 19, a looper 20 and another bridle 21 into the tandem mill 26 where it is rolled into cold-rolled strip C. The cold-rolled strip C moves forward to the annealing furnace 32 through an electrolytic cleaner 28. The annealed strip passes through a post treatment unit 34 and a skin-pass mill 38 and is then taken up on a tension reel 40.

The looper 4 is provided to allow the welding operation at a strip welder 2, while the looper 20 is for the width changing operation of the side trimmer 13. The strip welder 2 joins a previous coil H to a following coil H. A looper 30 is engineered for the roll and side changing operation at the tandem mill 26, while a looper 36 is for the coil splitting operation at the tension reel 40.

On the line just described, the stock H is elongated by not more than 7 percent between the bridles 8 and 10 of the mechanical descaler 6 to initiate a large number of cracks in the mill scale on the surface thereof. With the cracked scale scrubbed off at the brushing unit 11 and unwanted side edges removed by the side trimmer 13, the stock H passes into the pickling tank 14 where a substantially uniform rate of travel is maintained because the pickling rate differs little in the head-end, middle and tail-end portions of the coil H as will be described later. Accordingly, the looper 20 need not be long enough to absorb changes in the travel speed of strip that are usually encountered on conventional lines. Even without such a provision, the strip is fed to the tandem mill 26 at a substantially uniform speed, exercising no detrimental effect on the annealing furnace 32.

Figure 2:
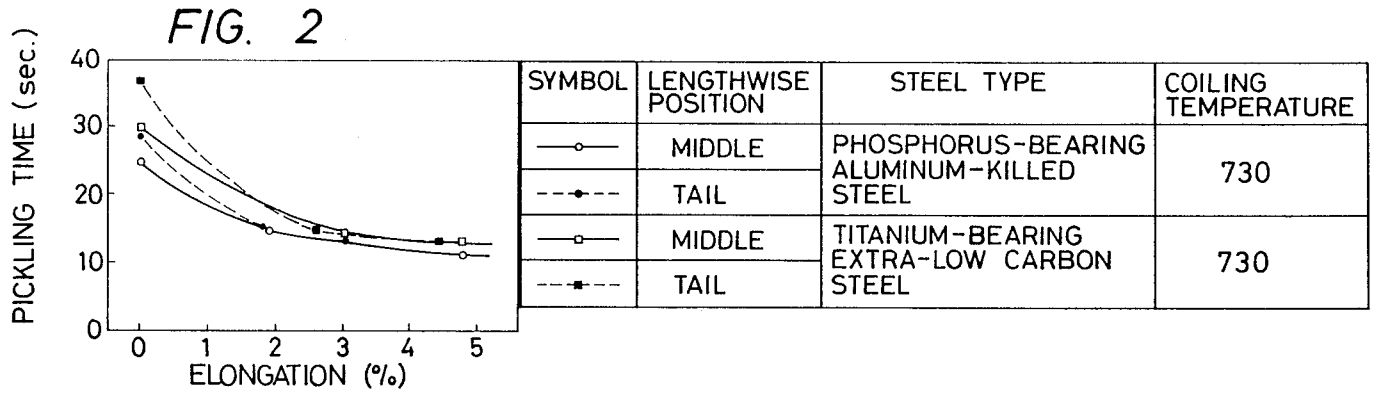
FIG. 2 graphically shows the relationship between the percent elongation of steel strip and pickling time in the middle and tail-end portions thereof.

As mentioned before, the tension-leveller-type scale breaker 7 causes the pre-cold-rolled breakdown to elongate by 7 percent maximum. But, the extent of elongation should preferably be kept between 2 and 5 percent for the following reason:

As mentioned previously, the pickling rate varies in the head-end, middle and tail-end portions along the length of steel strip. FIG. 2 shows the pickling rates of strips elongated by a tension leveller. The figure is concerned with the tail-end portion B and the middle portion M which require the longest and shortest pickling time, respectively.

The experiment was conducted by pickling 4 mm thick materials in a 10 percent (by weight) solution of hydrochloric acid at a temperature of 70° C. and coiling up the pickled strip at a temperature CT of 730° C. As is obvious from FIG. 2, an approximately equal pickling time was recorded in the middle and tail-end portions, even on different types of steel, when 2 percent or greater elongation was imparted. The analogy in pickling time begins to dwindle when elongation reaches 5 percent. By elongating the breakdown by 2 to 5 percent, the tail-end portion that is intrinsically less descalable can be passed through the pickling tank at a higher speed substantially comparable to the travel speed of the middle portion that is easier to descale.

A descaling method disclosed in Japanese Provisional Patent Publication No. 101220-1984 elongates the hotrolled breakdown by at least 3 percent using a set of bending and stretching rollers. By so doing, a uniform pickling rate is secured across the width of the strip in the following pickling process.

As opposed to the technology according to Japanese Provisional Patent Publication No. 101220-1984, this invention is based on a discovery that a substantially uniform pickling rate is obtained along the length of a strip that is elongated by not more than 7 percent on a tension-leveller-type scale breaker prior to pickling. This knowledge is applied to a continuous cold reduction line comprising a continuous pickling, cold reduction and annealing unit. Clearly, this invention has an entirely different object, construction, operation and effect from the technology of Japense Provisional Patent Publication No. 101220-1984.

With conventional concepts, the looper 20 is required to have a length of approximately 150 m on a typical mill having a production capacity of 220 tons per hour. In contrast, this invention can do away with any longer looper length than approximately 75 m that is needed for changing the knife width on the side trimmer 13.

Furthermore, the work load on the pickling tank 14 is lower than the conventional, workload so much shorter tank lengths can be used since the stock supplied thereto has been already descaled at the mechanical descaler 6. Fed with steel strip at a speed equal to the pace at which the middle portion thereof is pickled, the tandem mill 26 performs high-efficiency rolling, permitting the strip to be passed through the subsequent annealing furnace 32 at a higher speed and turning out a greater tonnage of product.

PREFERRED EMBODIMENT II

Figure 3:
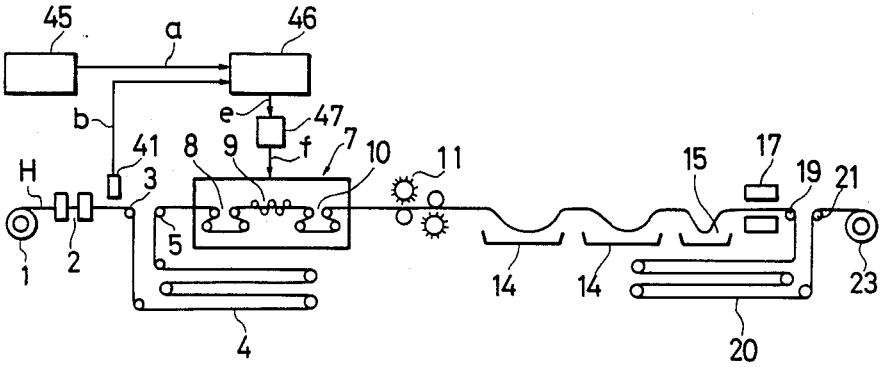
FIG. 3 is a block diagram showing a system that performs descaling on the principle of feedforward control according to this invention.

FIG. 3 shows another preferred embodiment of this invention. In the following description, parts similar to their counterparts in preferred embodiment I will be designated by similar reference characters, with no detailed description given thereto.

Here, a pickling tank 14 is followed by a hot rinse tank 15, a dryer 17, a bridle 19, an exit-end loop car 20, a bridle 21 and tension reel 23 in that order. A scale detector 41 is provided on the exit side of a welder 2. Also, a control computer 46 (Mitsubishi M60-30) and a controller 47 connected thereto are provided. A host computer 45 (Mitsubishi M60-30) and the scale detector 41 are connected to the control computer 46.

After being released from a payoff reel 1 and stored on an entry-side loop car 4, the hot-rolled breakdown H is elongated by not more than 7 percent at a tension-leveller-type scale breaker 7. A brush roll 11 scrubs off the loosened mill scale from the steel stock. Pickled in the pickling tank 14 and passed through the hot rinse tank 15 and some other following units, the stock H is coiled up on the tension reel 23.

To the control computer 46 are inputted data "a" concerning the manufacturing conditions of the hot-rolled breakdown from the host computer 45 and data "b" concerning the properties and amount of scale from the scale detector 41. When there is surplus pickling capacity, at least either of the intermesh of the work rolls 9 on the tension-leveller-type scale breaker 7 or the difference in the rotational speed between the entry- and exit-side bridles 8 and 10 is varied to control the amount of elongation given to the stock H to the smallest possible value with which descaling can be completed within a predetermined length of time without causing insufficient pickling.

Figure 4:
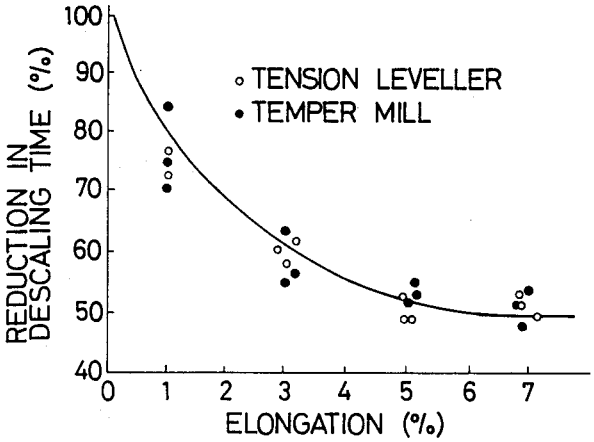
FIG. 4 graphically shows an example of the relationship between the elongation imparted to the hot-rolled breakdown by a tension-leveller-type and a temper-mill-type scale breaker and the ratio of reduction in descaling time.

FIG. 4 exemplifies the relationship between the percent elongation given to the stock by a tension-leveller- and a temper-mill-type scale breaker and the savings achieved in descaling time. Here, the ratio of savings in descaling time is defined as $(T_R/T_O)\times 100(\%)$, where $T_O$ is the descaling time with the un-elongated stock and $T_R$ is that the descaling time with the elongated stock. As is obvious from the figure, descaling time does not become shorter when the ratio of elongation exceeds 7 percent. As such, the ratio of elongation should preferably be kept at a maximum of 7 percent while it must be high enough to initiate such cracks in the mill scale as will facilitate later descaling.

Figure 5:
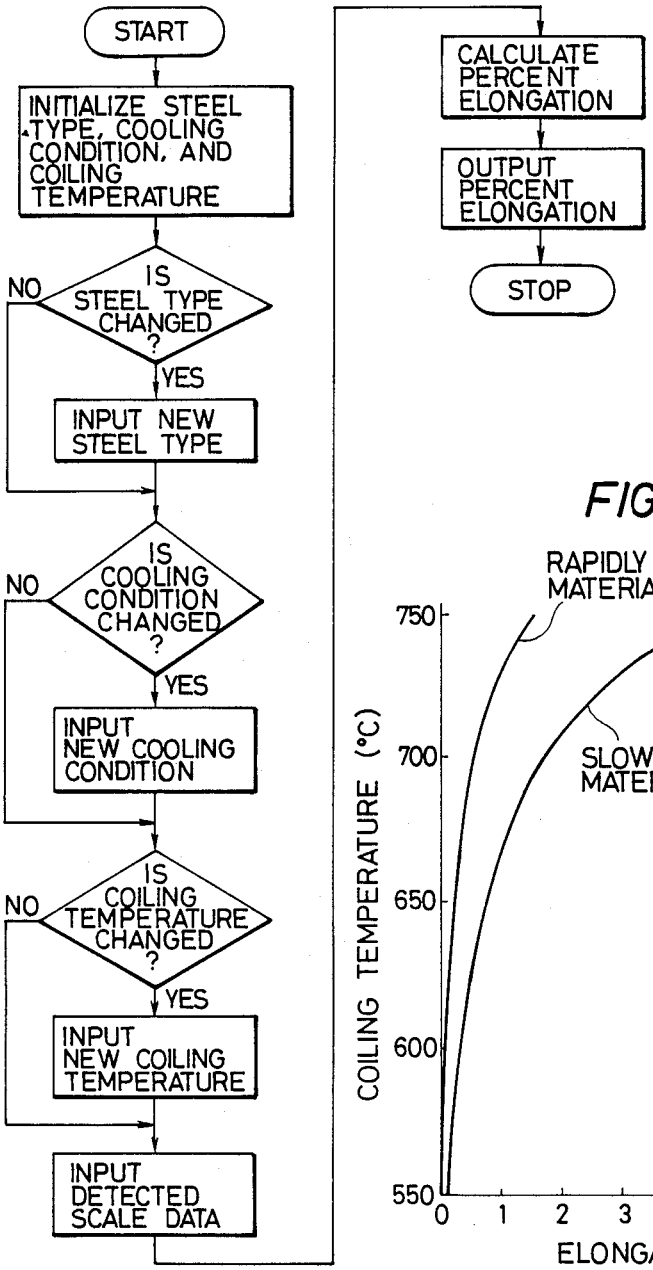
FIG. 5 is a flow chart showing the steps by which the optimum percent elongation is determined in the feed-forward controlled descaling process.

With the equipment just described, the optimum percent elongation for the descaling of the hot-rolled breakdown H is determined by the following procedure, which is shown in FIG. 5 in the form of a flow chart.

Figure 6:
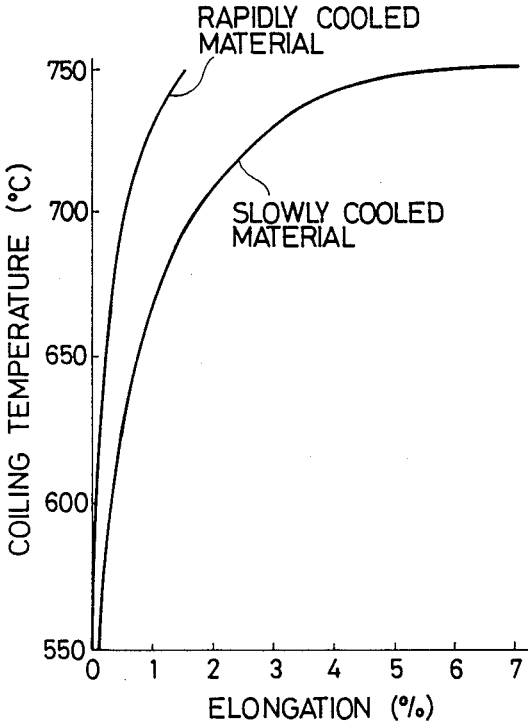
FIG. 6 is a diagram showing curves from which the desired percent elongation is derived.

The type or grade, cooling condition and coiling temperature of the hot-rolled stock are initially set in the control computer 46. Then, whether the steel type or grade, cooling condition and coiling temperature have been changed or not is checked one after another based on the data supplied from the host computer 45. If any change has been made, the setting on the changed parameter is modified. Next, the properties and quantity of scale determined by the scale detector 41 is inputted in the control computer 46, where the desired percent elongation is calculated on the basis of the supplied data. FIG. 6 shows an example of curves from which percent elongation is derived. Various curves are preliminarily drawn for various conditions and stored in the control computer 46. If the cooling condition (such as rapid cooling or slow cooling, as in the example being discussed) and coiling temperature are specified, the desired percent elongation can be derived from the memorized curves. The obtained percent elongation "e" is outputted from the control computer 46 to the controller 47. Based on the supplied percent elongation, the controller 47 outputs the desired tensile force "f" to the tension-leveller-type scale breaker 7.

PREFERRED EMBODIMENT III

Figure 7:
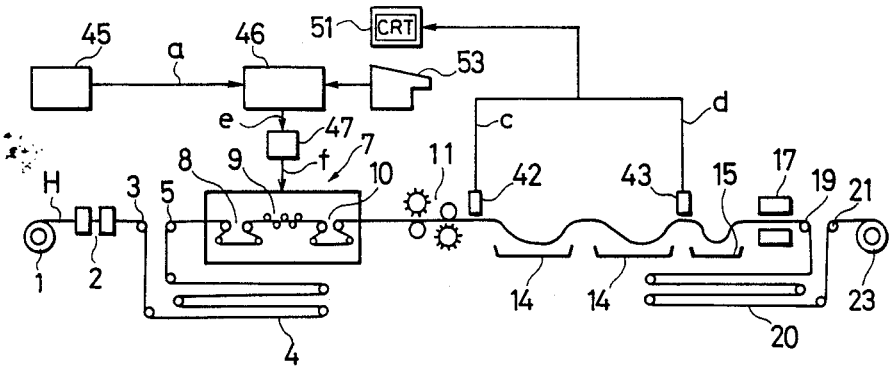
FIG. 7 is a block diagram of a system that performs descaling on the feed-back principle according to this invention.

FIG. 7 shows still another preferred embodiment of this invention, in which ITV cameras 42 and 43 are respectively provided on the exit side of a brush roll 11 and a pickling tank 14. While the ITV camara 42 views the condition of scale breaking, the ITV camera 43 views the condition of scale removal. The ITV cameras 42 and 43 are connected to a monitor television 51 on which the viewed conditions are displayed.

With this equipment, data "a" concerning the manufacturing conditions of the hot-rolled stock are inputted from a host computer 45 to a control computer 46. Also, an inspector inputs data "c" and "d" concerning the scale breaking and removing conditions, which are viewed on the monitor television 51, through a console 53 into the control computer 46. When there is surplus pickling capacity, at least either of the intermesh of the work rolls 9 on the tension-leveller-type scale breaker 7 or the difference in the rotational speed between the entry- and exit-side bridles 8 and 10 is varied to control the amount of elongation given to the stock H to the smallest possible value with which descaling can be completed within a predetermined length of time without causing insufficient pickling.

Figure 8:
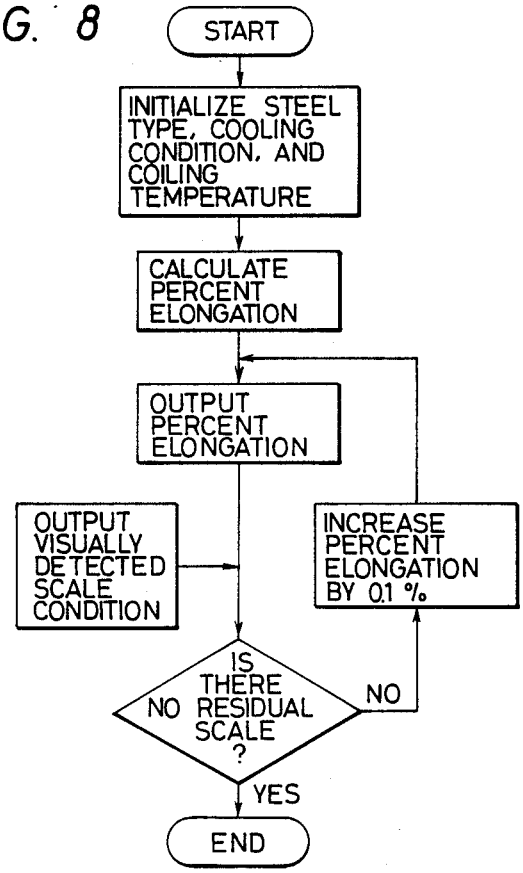
FIG. 8 is a flow chart showing the steps by which the optimum percent elongation is determined in the feed-back controlled descaling process.

With the equipment just described, the optimum percent elongation for the descaling of the hot-rolled breakdown H is determined by the following procedure, which is shown in FIG. 8 in the form of a flow chart.

The type or grade, cooling condition and coiling temperature of the hot-rolled stock are initially set in the control computer 46. Then as in the case of preferred embodiment II, the desired percent elongation is calculated based on the supplied data. The obtained percent elongation "e" is outputted from the control computer 45 to a controller 47, which, in turn, outputs the desired tensile force "f", which is determined on the basis of the percent elongation "e", to a tension leveller-type scale breaker 7. Also, an inspector inputs the scale breaking and removal conditions displayed on the monitor television 53 into the control computer 46. If the data from the inspector points to the existence of residual scale, the control computer 46 causes the controller 45 to increase the tensile force "f" outputted to the tension-leveller-type scale breaker 7, thereby increasing the percent elongation given to the hot-rolled stock H by 0.1 percent. The incremental increase in percent elongation "e" is repeated until scale has been throughly removed.

PREFERRED EMBODIMENT IV

Figure 9A:
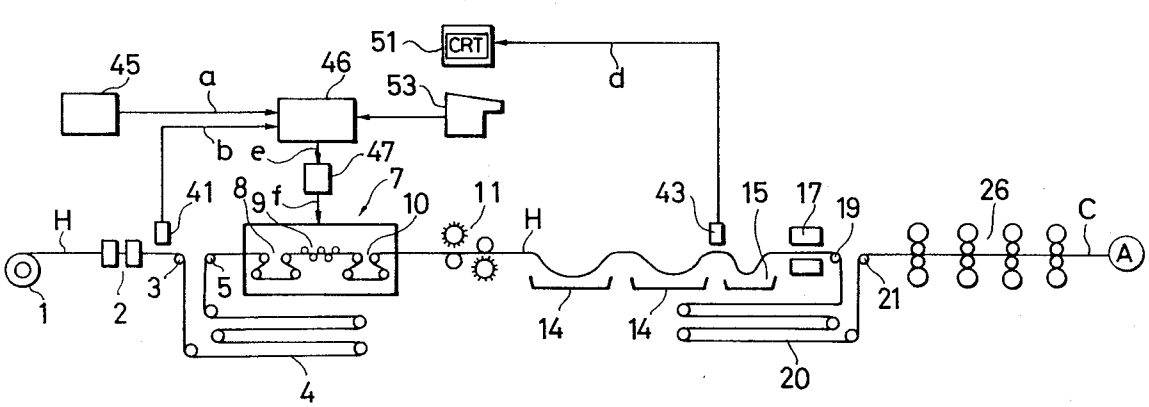
FIGS. 9A and 9B show a block diagram of a system that performs descaling on the feed-forward and feed-back principles according to this invention.
Figure 9B:
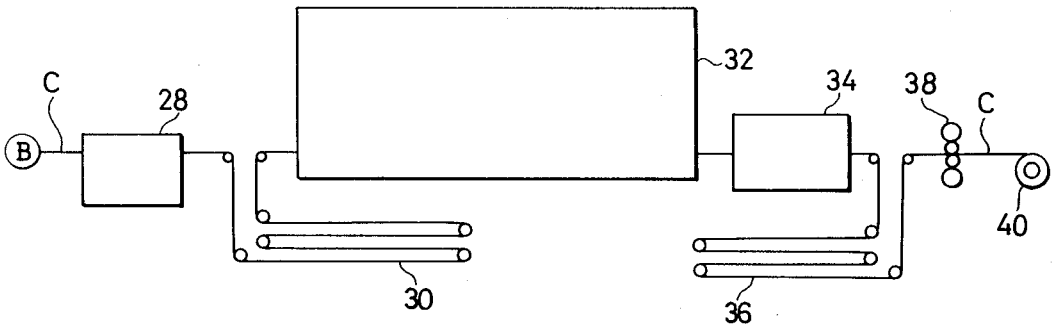

FIGS. 9A and 9B show a line on which cold reduction and continuous annealing are continuously performed following scale breaking and removing.

An exit-side loop car 20 and a bridle 21 are followed by a cold reduction mill train 26, an electrolytic cleaner 28, an entry-side loop car 30, a continuous annealing furnace 32, a post treatment unit 34 for the annealed cold-rolled stock, an exit-side loop car 36, a skinpass mill 38 and a tension reel 40, in that order. On the above line, the pickled hot-rolled stock H immediately undergoes cold reduction and continuous annealing.

Instead of continuously carrying out cold reduction and continuous annealing after scale breaking and removing as in the preferred embodiment just described, only cold reduction may be performed following descaling. In the latter case a tension reel will be provided in position A in FIG. 9A. Also, the entry-side speed of the cold reduction mill 26 will be inputted in the control computer 46 for the calculation of percent elongation.

Figure 10:
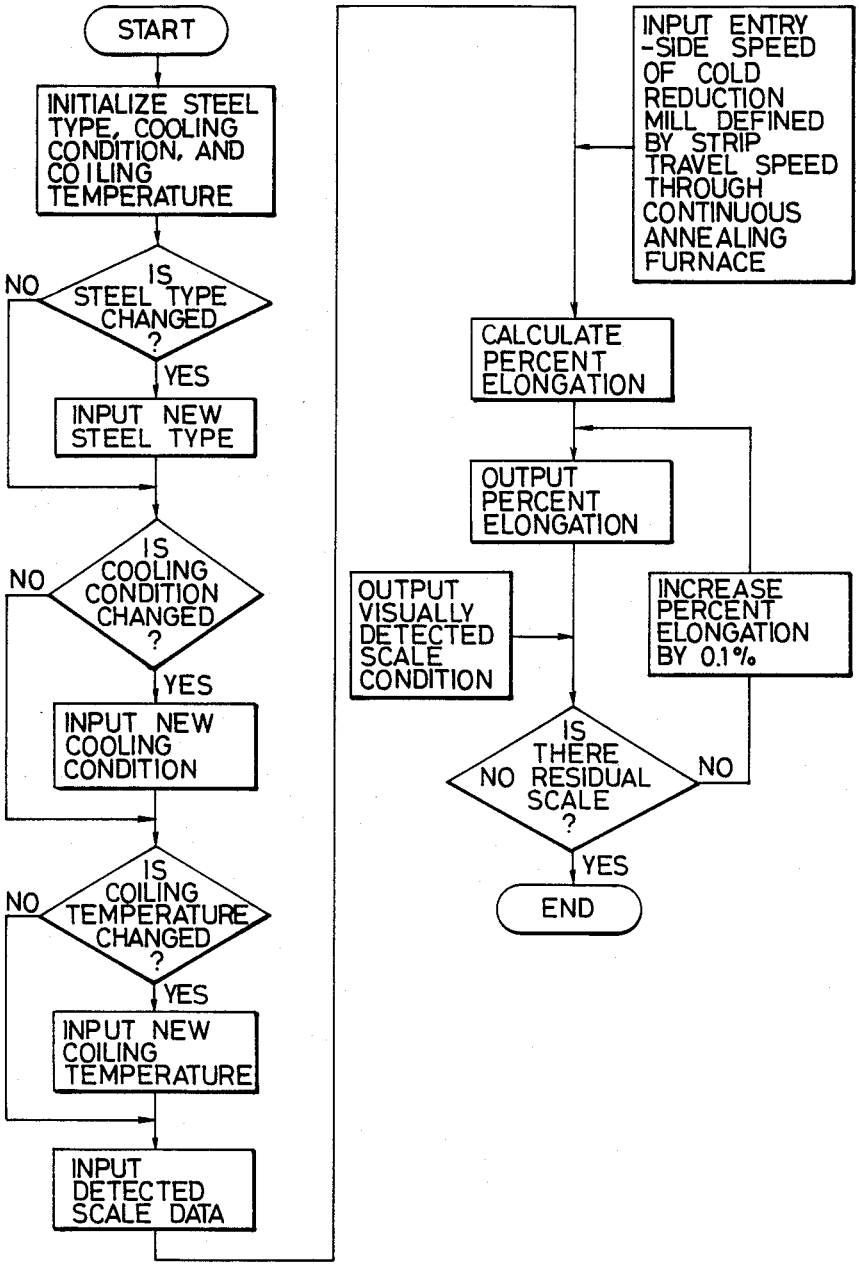
FIG. 10 is a flow chart showing the steps by which the optimum percent elongation is determined in the feed-forward and feed-back controlled descaling processes.

The following paragraph describes a descaling method that employs the percent elongation controlled by implementing not only feedforward control but also feedback control on the equipment shown in FIGS. 9A and 9B FIG. 10 shows a flow chart of the procedure by which percent elongation is controlled. Feedforward and feedback controls are performed in the same manner as that described with regard to the preceding preferred embodiments, except in that the speed of cold reduction is determined by considering the speed of strip travel in the continuous annealing furnace 32 because cold reduction and continuous annealing are performed in succession after descaling. Therefore, the entry-side speed of the cold reduction mill 26 is inputted in the control computer 46. Then, percent elongation is calculated on the basis of the manufacturing and cooling conditions of the hot-rolled stock H, the data from the scale detector 41 and the entry-side speed of the cold reduction mill 26. From the entry-side speed of the cold reduction mill is first calculated the pickling speed. Then, the desired percent elongation is derived from the calculated pickling speed. When the entry-side speed of the cold reduction mill is low, for example, the pickling time will be longer and, therefore, the percent elongation given to the stock lower.

Figure 11:
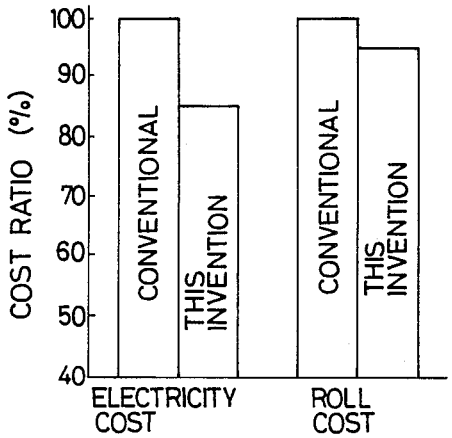
FIGS. 11 to 13 graphically compare the electricity and roll costs between the conventional technologies and this invention.
Figure 12:
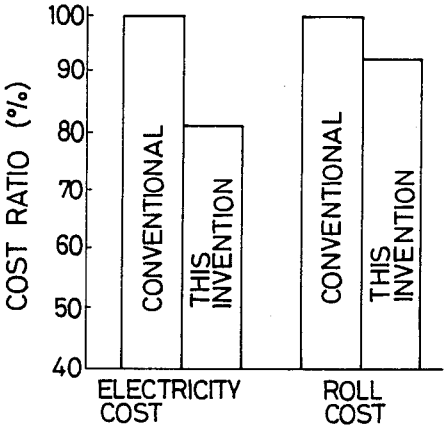
Figure 13:
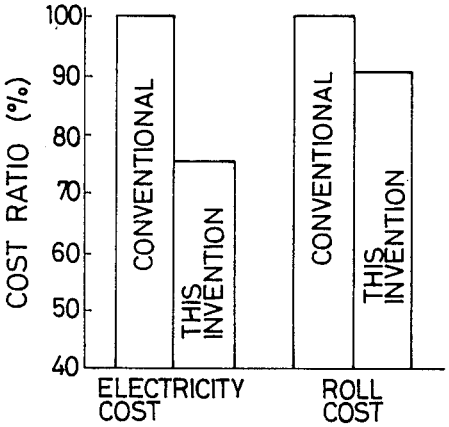

FIGS. 11 to 13 compare the electricity and roll costs incurred by the method of this invention with those of conventional methods. FIG. 11 is concerned with a process involving up to the pickling and drying steps (which are implemented on the equipment shown in FIG. 3). As is obvious from the figure, the method according to this invention delivers savings of approximately 25 percent and 5 percent in electricity and roll costs, respectively. FIG. 12 is concerned with a process involving up to the cold reduction step (implemented on the equipment up to point A in FIG. 9A). The savings in electricity and roll costs achieved by this method are approximately 20 percent and 7 percent, respectively. FIG. 13 is concerned with a process involving up to the continuous annealing step (implemented on the whole line of equipment shown in FIGS. 9A and 9B). The electricity and roll costs savings achieved here are approximately 25 percent and 10 percent, respectively.

What is claimed is:

1. A method of removing mill scale from the surface of hot-rolled strip coil in the manufacture of cold-rolled steel strip using an apparatus comprising an uncoiler linked to a scale removing unit by a first looper, a tandem cold-reduction mill linked to the scale removing unit by a second looper and a continuous annealing unit linked to the tandem cold-reduction mill by a third looper, comprising the steps of:

breaking the mill scale on the surface of the hot-rolled strip coil by elongating the running hot-rolled strip coil to a predetermined percent elongation, controlling the predetermined percent elongation during the elongating of the hot-rolled strip coil as a function of at least one of the manufacturing conditions of the hot-rolled strip coil and the properties and quantity of the mill scale on the hot-rolled strip coil so that the top, bottom and middle thereof of the hot-rolled strip coil will be pickled at substantially the same speed; and removing the broken scale from the surface of the elongated hot-rolled strip coil.

2. A method according to claim 1, in which the hot-rolled strip coil is elongated by not more than 7 percent by means of a tension leveller.

3. A method according to claim 1, in which the hot-rolled strip coil is elongated by not more than 7 percent by means of a temper mill.

4. A method according to claim 1, in which the broken scale is removed from the surface of the hot rolled strip coil by at least one of brush scrubbing, pickling, wet blasting and dry blasting.

5. A method according to claim 1, in which the breaking of mill scale and the removal of the broken scale are effected immediately before cold reduction in a continued series of process steps in which cold reduction is performed following descaling.

6. A method according to claim 1, in which the breaking of mill scale and the removal of the broken scale are performed immediately before cold reduction in a continued series of process steps in which cold reduction and continuous annealing are successively effected following descaling.

7. A method of removing mill scale from the surface of hot-rolled strip coil in the manufacture of cold-rolled steel strip using an apparatus comprising an uncoiler linked to a scale removing unit by a first looper, a tandem cold-reduction mill linked to the scale removing unit by a second looper and a continuous annealing unit linked to the tandem cold-reduction mill by a third looper, comprising the steps of:

breaking the mill scale on the surface of the hot-rolled strip coil by elongating the running hot-rolled strip coil to a predetermined percent elongation;

removing the broken mill scale from the hot-rolled strip coil;

detecting the condition of the mill scale downstream of at least one of the scale breaking and the scale removing steps adjacent the exit side thereof; and controlling the predetermined percent elongation as a function of the detected condition of the mill scale so that the top, bottom and middle of the hot-rolled strip coil can be pickled at substantially the same speed.

8. A method according to claim 7, in which the hot-rolled strip coil is caused to elongate by not more than 7 percent by means of a tension leveller.

9. A method according to claim 7, in which the broken scale is removed from the surface of the hot-rolled strip coil by at least one of brush scrubbing, pickling, wet blasting and dry blasting.

10. A method according to claim 7, in which the breaking of mill scale and the removal of the broken scale are effected immediately before cold reduction in a continued series of process steps in which cold reduction is performed following descaling.

11. A method according to claim 7, in which the breaking of mill scale and the removal of the broken scale are performed immediately before cold reduction in a continued series of process steps in which cold reduction and continuous annealing are successively effected following descaling.

12. A method according to claim 7, in which the hot-rolled strip coil is caused to elongate by not more than 7 percent by means of a temper mill.

13. A method according to claim 7, wherein said breaking step is performed using a tension-leveler-type scale breaker and said removing step is performed using a brush, and at least two pickling tanks including first pickling tank and a second pickling tank.

14. A method of removing mill scale from the surface of hot-rolled strip coil in the manufacture of cold-rolled steel strip using an apparatus comprising an uncoiler linked to a scale removing unit by a first looper, a tandem cold-reduction mill linked to the scale removing unit by a second looper and a continuous annealing unit linked to the tandem cold-reduction mill by a third looper, comprising the steps of:

breaking the mill scale on the surface of the hot-rolled strip coil by elongating the running hot-rolled strip coil to a predetermined elongation, controlling the predetermined percent elongation as a function of at least one of the manufacturing conditions of the hot-rolled strip coil and the properties and quantity of the mill scale on the hot-rolled strip coil so that the top, bottom and middle thereof can be pickled at substantially the same speed;

removing the broken mill scale from the hot-rolled strip coil;

detecting the condition of the mill scale downstream of at least one of the scale breaking and the scale removing steps adjacent the exit side thereof; and further controlling the predetermined percent elongation as a function of the detected condition of the mill scale.

15. A method according to claim 14, in which the breaking of mill scale and the removal of the broken scale are performed immediately before cold reduction in a continued series of process steps in which cold reduction and continuous annealing are successively effected following descaling.

16. A method according to claim 14, in which the hot-rolled strip coil is elongated by not more than 7 percent means of a tension leveller.

17. A method according to claim 14, in which the hot-rolled strip coil is elongated by not more than 7 percent by means of a temper mill.

18. A method according to claim 14, in which the broken scale is removed from the surface of the hot-rolled breakdown by at least one of brush scrubbing, pickling, wet blasting and dry blasting.

19. A method according to claim 14, in which the breaking of mill scale and the removal of the broken scale are effected immediately before cold reduction in a continued series of process steps in which cold reduction is performed following descaling.

20. A method according to claim 14, wherein said breaking step is performed using a tension-leveler-type scale breaker and said removing step is performed using a brush, and at least two pickling tanks including a first pickling tank and a second pickling tank.

21. A cold-rolled steel strip manufacturing apparatus which comprises:

an uncoiler linked to a scale removing unit by a first looper, a tandem cold-reduction mill linked to the scale removing unit by a second looper and a continuous annealing unit linked to the tandem cold-reduction mill by a third looper;

the scale removing unit comprising a tension-leveller-type scalebreaker means for causing hot-rolled strip coil to elongate by 2 percent to 7 percent so that the top, bottom and middle thereof can be pickled at substantially the same speed, a brush unit to scrub off mill scale from the surface of the elongated hot-rolled strip coil and at least one pickling tank disposed such that the hot-rolled strip passes therethrough in series; and the scale removing unit being adapted to pass the entire length of the hot-rolled strip coil at a substantially constant speed through the tandem cold-reduction mill.

22. The apparatus as claimed in claim 21, further comprising means for controlling said tension-leveller-type scalebreaker means during elongation of the hot-rolled strip coil as a function of at least one of the manufacturing conditions of the hot-rolled strip coil and the properties and quantity of mill scale on the hot-rolled strip coil.

23. The apparatus as claimed in claim 22, wherein said means for controlling said tension-leveller-type scalebreaker means includes means for detecting the condition of the mill scale on the hot-rolled strip coil prior to the entry of the hot-rolled strip coil into said tension-leveller-type scalebreaker means.

24. The apparatus as claimed in claim 22, wherein said means for controlling said tension-leveller-type scalebreaker means includes means for detecting the condition of the mill scale on the hot-rolled strip coil after the hot-rolled strip coil passes through said pickling tank.

25. The apparatus as claimed in claim 22, wherein said means for controlling said tension-leveller-type scalebreaker means includes means for detecting the condition of the mill scale on the hot-rolled strip coil prior to the entry of the hot-rolled strip coil into said tension-leveller-type scalebreaker means and after the hot-rolled strip coil passes through said pickling tank.

26. The apparatus as claimed in claim 22, wherein said means for controlling said tension-leveller-type scalebreaker means includes means for detecting the condition of the mill scale on the hot-rolled strip coil between said brush unit and said pickling tank and after the hot-rolled strip coil passes through said pickling tank, said detecting means being electrically connected to a display means for indicating the condition of the mill scale detected by said detecting means whereby an operator can adjust said tension-leveller-type scalebreaker means to elongate the hot-rolled strip coil to a desired value within the range of 2 to 7 percent.

27. The apparatus as claimed in claim 22, wherein said means for controlling said tension-leveller-type scalebreaker means includes first detecting means for detecting the condition of the mill scale on the hot-rolled coil strip prior to the entry of the hot-rolled coil strip into said tension-leveller-type scalebreaker means and second detecting means for detecting the condition of the mill scale after the hot-rolled strip coil passes through said pickling tank, said second detecting means being electrically connected to a display means for indicating the condition of the mill scale detected by said second detecting means whereby an operator can adjust said tension-leveller-type scalebreaker means to elongate the hot-rolled strip coil to a desired value within the range of 2 to 7 percent.

* * * * *